US005297930A

United States Patent [19]

Moore

[11] Patent Number: 5,297,930

[45] Date of Patent: Mar. 29, 1994

[54] ROTATING STALL SUPPRESSION

[75] Inventor: Franklin K. Moore, Ithaca, N.Y.

[73] Assignee: Cornell Research Foundation, Inc., Ithaca, N.Y.

[21] Appl. No.: 815,028

[22] Filed: Dec. 31, 1991

[51] Int. Cl.[5] ..... F04D 29/40

[52] U.S. Cl. ..... 415/182.1; 415/208.1; 415/914

[58] Field of Search ..... 415/182.1, 183, 198.1, 415/208.1, 914

[56] References Cited

U.S. PATENT DOCUMENTS

| | | | |
|---|---|---|---|
| 1,693,352 | 11/1928 | Schmidt | 415/183 |
| 2,233,991 | 3/1941 | Walters | 415/183 |
| 2,308,685 | 1/1943 | Hagen | 415/208.2 |
| 2,340,166 | 1/1944 | Young et al. | 415/183 |
| 2,997,229 | 8/1961 | Quan | 415/208.1 |
| 3,039,675 | 6/1962 | Reichner | 415/183 |
| 3,118,594 | 1/1964 | Helmbold | 415/208.1 |
| 3,273,654 | 9/1966 | Pinnes | 415/183 |
| 3,421,446 | 1/1969 | Strscheletzly et al. | 415/182.1 |
| 3,724,968 | 4/1973 | Friberg et al. | 415/208.1 |
| 3,986,790 | 10/1976 | Yamaguchi et al. | 415/220 |
| 4,116,584 | 9/1978 | Bammert et al. | 415/199.5 |
| 4,196,472 | 4/1980 | Ludwig et al. | 364/431 |
| 4,255,082 | 3/1981 | Goebel | 415/182.1 |
| 4,265,593 | 5/1981 | Hatton et al. | 60/39.29 |
| 4,411,588 | 10/1983 | Currah, Jr. | 415/220 |
| 4,482,293 | 11/1984 | Perry | 415/182.1 |
| 4,511,308 | 4/1985 | Russell et al. | 415/220 |
| 4,622,808 | 11/1986 | Kenison et al. | 416/183 |
| 4,799,857 | 1/1989 | Bauer et al. | 415/208.1 |
| 4,802,821 | 2/1989 | Krietmeier | 415/208.2 |
| 4,844,692 | 7/1989 | Minkkinen et al. | 415/208.1 |
| 4,938,661 | 7/1990 | Kobayashi et al. | 415/199.1 |
| 4,967,550 | 11/1990 | Acton et al. | 60/39.29 |
| 5,005,353 | 4/1991 | Acton et al. | 60/39.281 |

FOREIGN PATENT DOCUMENTS

| | | | |
|---|---|---|---|
| 724553 | 8/1942 | Fed. Rep. of Germany | 415/208.1 |

OTHER PUBLICATIONS

*Mechanics and Thermodynamics of Propulsion*; Hill and Peterson; pp. 272–277; Copyright 1965.

Moore, F. K. "A Theory of Rotating Stall of Multistage Compressors: Part I—Small Disturbances," *ASME J. Eng. for Power*, 106, Apr. 1984, pp. 313–321.

Moore, F. K. "A Theory of Rotating Stall of Multistage Compressors: Part II—Finite Disturbances," *ASME J. Eng. for Power*, 106, Apr. 1984, pp. 321–326.

Moore, F. K. & Greitzer, E. M., "A Theory of Post-Stall Transients on Axial Compression Systems: Part I—Development of Equations," *ASME J. Eng. for Gas Turb, and Power*, 108, Jan. 1986; pp. 68–76.

Moore, F. K., "Stall Transients of Axial Compression Systems with Inlet Distortion," *AIAA J. of Propulsion of Power*, Nov./Dec. 2, 6, 1986; pp. 552–561.

*Primary Examiner*—John T. Kwon

*Attorney, Agent, or Firm*—Jones, Tullar & Cooper

[57] ABSTRACT

Rotating stall in an axial-flow compressor is suppressed by the positioning of a fixed inlet flow divider in the annular inlet flow passage upstream of the compressor. The inlet flow divider is aligned with the flow of fluid through the duct and acts to block or interfere with any rotating wave in the inlet and thereby suppresses rotating stall in the compressor.

12 Claims, 4 Drawing Sheets

ROTATING STALL SUPPRESSION

This invention was made with Government support under Grant No. NAG-3-349, awarded by NASA. The Government has certain rights in the invention.

FIELD OF THE INVENTION

The present invention is directed generally to rotating stall suppression in axial machines. More particularly, the present invention is directed to the suppression of axial stall in an axial-flow compressor. Most specifically, the present invention is directed to the suppression of rotary stall in an axial-flow compressor by use of an inlet divider. The inlet divider is positioned in the annular inlet duct of the axial-flow compressor. This divider is aligned with the nominal through flow of fluid in the annular inlet duct and will suppress rotating stall in circumstances where it would otherwise occur. The essential action of the divider is to block the formation or interfere with any rotating wave in the inlet to the axial-flow compressor.

DESCRIPTION OF THE PRIOR ART

Rotating stall is an important phenomenon that can lead to compressor damage in an axial-flow machine such as an axial flow compressor. One discussion of rotating stall in axial compressors is presented in the text "Mechanics and Thermodynamics of Propulsion" by Hill and Peterson and published by Addison-Wesley Publishing Co. in 1965. As discussed at pages 274 and 275, " . . . if a blade row is on the verge of stalling, it is likely that one particular blade will stall before its neighbors do.". Once a single blade has stalled, there is created a flow diversion away from the stalled blade. This flow diversion will tend to overload one blade adjacent the stalled blade while unloading the other blade that is adjacent the stalled blade. The overloaded blade will now stall and will thus create a flow diversion which will unload and thus unstall the originally stalled blade. The shifting or rotating of the stall cell from blade to blade continues and creates the condition of rotating stall.

As the stall cell rotates or propagates around the blades in an array of, for example inlet guide vanes in an axial-flow compressor, it creates alternating loading and unloading of the blades and thus gives rise to alternating stresses on the blades. If the forcing frequency of the stress happens to match a blade vibrational frequency, large stresses will become present and can create fatigue failure that will result in complete destruction of an entire blade row. This text's discussion of rotating stall concludes the "Little can be done to prevent this failure, other than avoiding operation at speeds corresponding to resonance.".

The phenomenon of rotating stall in axial machines, such as axial-flow compressors is also discussed in various prior U.S. patents. The following are patents in which rotating stall is either discussed or dealt with:

| U.S. Pat. No. | Patentee |
|---|---|
| 4,116,584 | Bammert et al |
| 4,196,472 | Luawig et al |
| 4,265,593 | Hatton et al |
| 4,622,808 | Kenison et al |
| 4,938,661 | Kobayashi et al |
| 4,967,550 | Acton et al |

-continued

| U.S. Pat. No. | Patentee |
|---|---|
| 5,005,353 | Acton et al |

These various prior art patents either utilize relatively complex active structural assemblies or sophisticated stall control systems that provide a warning of the advent of rotating stall in an axial machine such as an axial compressor so that the operating parameters of the compressor can be changed to avoid the rotating stall.

It will be apparent that a need exists for an apparatus which will suppress rotating stall in axial machinery and which is structurally uncomplicated and does not rely on expensive, sophisticated sensing and measuring circuitry. The rotating stall suppression apparatus in accordance with the present invention overcomes the limitations of the prior art devices and is a significant improvement over these prior art devices.

SUMMARY OF THE INVENTION

It is an object of the present invention to provide for the suppression of rotating stall.

Another object of the present invention is to suppress rotating stall in an axial machine.

A further object of the present invention is to provide rotating stall suppression in an axial-flow compressor.

Yet another object of the present invention is to provide an inlet flow divider in the inlet of an axial-flow compressor.

Still a further object of the present invention is to provide an inlet flow divider that will block or interfere with any rotating wave in the inlet of an axial-flow compressor.

Even yet another object of the present invention is to provide an inlet flow divider which is aligned with the through flow in the inlet duct of an axial-flow compressor.

As will be discussed in detail in the description of the preferred embodiment which is set forth subsequently, rotating stall in an axial machine, such as an axial-flow compressor is suppressed in accordance with the present invention by placement of an inlet divider in the annular inlet flow passage that directs fluid flow to the inlet guide vanes of the compressor. The inlet divider is aligned with the normal through flow of fluid in the inlet duct. Its leading edge is preferably located several radii upstream of the compressor while its trailing edge should be a fraction of a radius upstream. The divider will prevent the formation of a rotating wave in the inlet duct or will interfere with its propagation. This prevents the appearance of such a wave in the compressor itself. By preventing such a rotating wave from appearing in the compressor, the suppression of rotating stall in the inlet guide vanes of the compressor will be effected. The divider, since it is aligned with the nominal flow of fluid through the inlet duct, will not substantially disturb the flow. Thus the divider plate does not interfere with the normal operation of the axial-flow compressor.

The inlet divider to suppress rotating stall of axial compressors in accordance with the present invention overcomes many of the limitations of the prior art devices. It utilizes a single, passive, fixed divider in the inlet duct to block or interfere with any rotating waves in the duct which may give rise to rotating stall in the inlet guide vanes. While more than one such divider could be used, if desired, for reasons of balance or symmetry, the subject invention operates very well using only one flow divider. Thus it is quite structurally uncomplicated and is readily adoptable to both existing products as well as axial machinery under development.

In contrast with various prior devices which utilize complex electronic sensing arrangements and the like to sense the onset of rotating stall and then change the mass flow of the axial compressor to avoid operation in a range where rotating stall might take place, the rotating stall suppression assembly of the present invention acts to prevent the onset of rotating stall instead of avoiding operation in a range where it may occur. It thus does not rely on sophisticated sensor arrays, monitoring circuits and the like to suppress rotating stall. Rather, the present invention utilizes the placement of a passive, stationary flow divider in the inlet duct to suppress rotating stall.

The suppression of rotating stall in an axial machine by use of an inlet flow divider in accordance with the present invention overcomes the limitations of the prior art and provides a substantial advance in the art.

BRIEF DESCRIPTION OF THE DRAWINGS

While the novel features of the assembly for the suppression of rotating stall in an axial machine in accordance with the present invention are set forth with particularity in the appended claims, a full and complete understanding of the invention may be had by referring to the detailed description of the preferred embodiment, as is presented subsequently, and as illustrated in the accompanying drawings in which;

DESCRIPTION OF THE PREFERRED EMBODIMENT

Discussion or analysis of rotating stall in axial machines typically assume a geometrically ideal inlet which is axially symmetric and allows free passage of rotating waves of flow disturbance. However, it is chiefly the inlet configuration which defines the "spring constant" of the rotating-stall oscillator. Therefore it could be postulated that there are inlet configurations which would be inconsistent with appearance or amplification of rotating stall, even in the presence of inlet distortion. If such configurations exist, then the task of active control would be simplified; only surge would require active suppression. In the discussion which follows, reference will be made, by number, to the following articles and papers prepared by the inventor of the subject invention:

1. Moore, F. K. "A Theory of Rotating Stall of Multistage Compressors: Part I—Small Disturbances," *ASME J. Eng. for Power,* 106, April 1984, pp. 313–321.

2. Moore, F. K., "A Theory of Rotating Stall of Multistage Compressors: Part II—Finite Disturbances," *ASME J. Eng. for Power,* 106, April 1984, pp. 321–326.

3. Moore, F. K., and Greitzer, E. M., "A theory of Post-Stall Transients on Axial Compression Systems: Part I—Development of Equations," *ASME J. Eng. for Gas Turb, and Power,* 108, January 1986, pp 68–76.

4. Moore, F. K., "Stall Transients of Axial Compression Systems with Inlet Distortion," *AIAA J. of Propulsion of Power,* 2, 6, November-December 1986, pp 552–561.

These materials are incorporated herein by reference.

Figure 1:
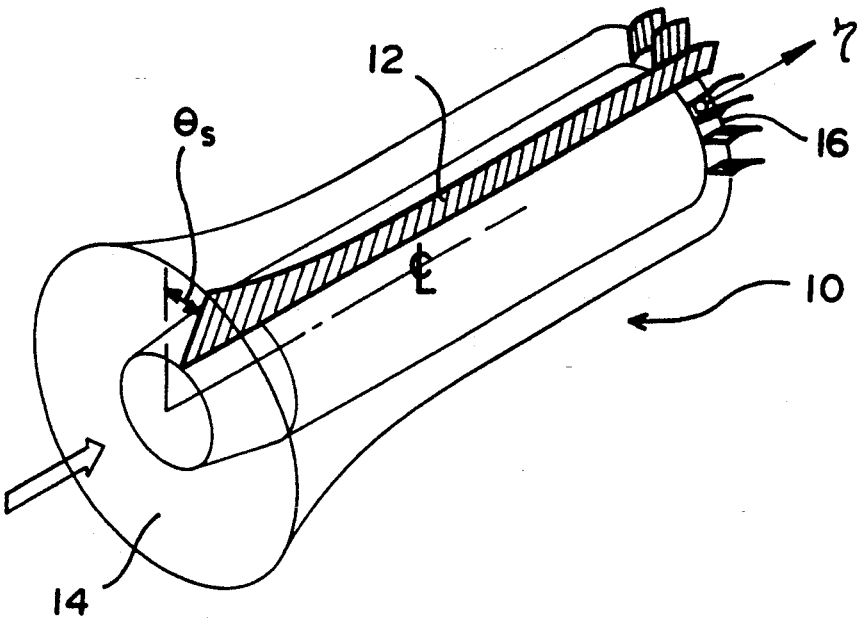
FIG. 1 is a perspective view, partly in cross-section of a straight annular duct with a single flow divider in accordance with the present invention.

For purposes of analyses, one may consider an infinite, straight annular duct generally at 10 [1–4] with a single flow divider 12, as depicted in FIG. 1. The divider 12 might extend all the way from the inlet entrance 14 to the compressor face, 16 as though one inlet guide vane were extended upstream with no incidence. Leaving skin friction out of account, such a divider would not disturb the design inlet flow which is purely axial, nor would it disturb the inlet flow if there were inlet distortion of simple shear type.

The following two analysis are set forth, one based on [3] assuming a small disturbance when the characteristic slope is positive, but no inlet distortion, and the other based on [4], assuming a finite, single harmonic disturbance, in the presence of inlet distortion.

Assume the axisymmetric characteristic is locally defined to have a positive slope $\sigma$, so that $$\psi_c = \Psi + \sigma(\tilde{\phi}'_{72})_{88} \tag{1}$$

Assuming no surge, Eq. (26) of [3] becomes $$m\,(\tilde{\phi}_\xi')_o + \frac{1}{2a}\,(2\tilde{\phi}_{\xi\eta}' + \tilde{\phi}_{\eta\theta}')_o - \sigma\,(\tilde{\phi}_\eta')_o = 0 \tag{2}$$

This equation gives the boundary condition at the compressor face for the disturbance velocity potential $\tilde{\phi}'$; in the inlet flow field, $\tilde{\phi}'$ satisfies Laplace's equation $$\tilde{\phi}'_{\Theta\Theta} + \tilde{\phi}'_{\eta\eta} = 0 \tag{3}$$

and it must vanish at upstream infinity ($\eta = -\infty$):

$$\tilde{\phi}'(\xi, \Theta, -\infty) = o \tag{4}$$

The general solution of Eqs (3,4) can be written $$\tilde{\phi} = \sum_{n=1}^{\infty} \frac{1}{n}\, e^{n\eta}\,(a_n \sin n\theta + b_n \cos n\theta) \tag{5}$$

where the coefficients $a^\eta$ and $b^\eta$ are functions of time, $\xi$. Substituting Eq. (5) into Eq. (2) gives $$\left(1 + \frac{ma}{n}\right)\frac{dan}{d\xi} - (a\sigma)\,a_n = \left(\frac{n}{2}\right)b_n \tag{6}$$

$$\left(1 + \frac{ma}{n}\right)\frac{dbn}{d\xi} - (a\sigma)\,b_n = \left(\frac{n}{2}\right)a_n \tag{7}$$

These equations can be combined to yield an equation for $a_\eta$ alone (and $b_\eta$ satisfies the same equation):

$$\left(1+\frac{ma}{n}\right)^2\frac{d^2a_n}{d\xi^2}-2a\sigma\left(1+\frac{ma}{n}\right)\frac{da_n}{d\xi}+\left(\frac{n^2}{4}+a^2\sigma^2\right)a_n=0 \quad (8)$$

Eq. (8) describes an harmonic oscillator with amplification; when the solution for $a^\eta$ and $b^\eta$ are put back into Eq. (5) they provide rotating-stall waves, growing in amplitude if the characteristic slope $\sigma$ is positive.

Now, one adds the new features of a divider 12 at, for example $\Theta_s=0$, by imposing the boundary condition $$\tilde{\phi}'_\Theta=0 \text{ at } \Theta=\Theta_s=0 \quad (9)$$

applicable to Eq. (5), for all $\eta$ and $\xi$. Thus, the requirement that the disturbance of circumferential velocity vanishes at the divider implies that $$\sum_{n=1}^{\infty} e^{n\eta}\, a_n(\xi)=0 \quad (10)$$

This equation must apply for all $\eta$, and therefore each individual $a^\eta$ must vanish. But if that is so, then Eq. (6) provides that each $b^\eta$ must vanish as well. One then will conclude that the postulated rotating wave cannot exist, regardless of whether $\sigma$ is positive, negative, or zero.

The same conclusion emerges if the divider condition is applied only over some restricted range of $\eta$, or even at one particular location, such as at the compressor face. In such a case, the exponential factor in Eq. (9) is a constant and may be omitted. But if the $a^\eta$ sum to zero for all $\xi$, all the $a^\eta$ must satisfy the same differential equation. In that case, the ratios of coefficients in the wave equation (8) must be independent of n, and one may show that this is impossible, even for just a pair of $a^\eta$. The implication of this result is that a divider 12 extending the whole length of the inlet may not be needed to forbid rotating stall. It may be necessary only to insure that circumferential velocity permanently stagnates somewhere in the inlet, perhaps, but not necessarily, at the compressor face.

Figure 2:
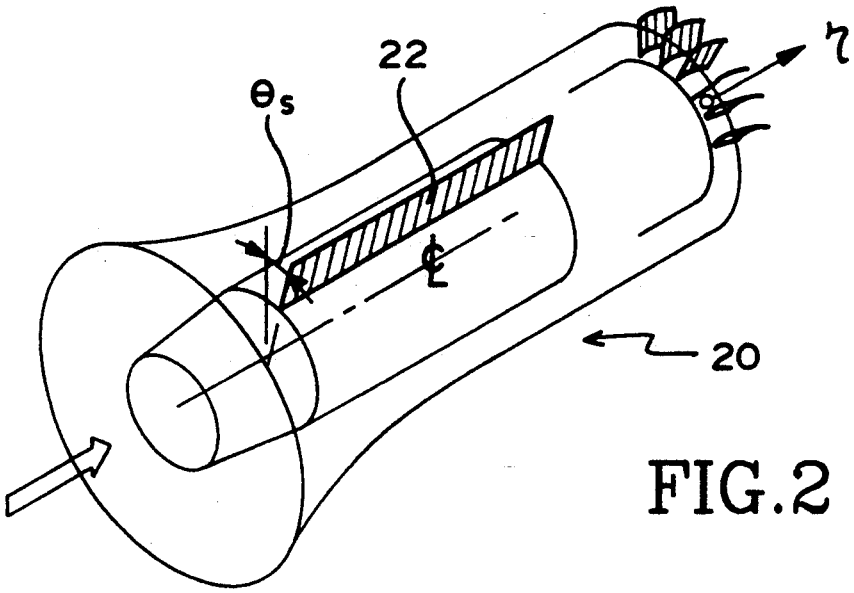
FIG. 2 is a perspective view, partly in section of a straight annular duct with a shortened flow divider in accordance with the present invention.

It may be desirable to avoid the placement of a divider at the compressor face because of the impulsive loading of the first rotor which would result from the divider wake. A configuration such as the one shown generally at 20 with a shortened divider 22 in FIG. 2 would have sufficient "divider effect". If there is inlet distortion, then there is already asymmetry in the problem, and the divider should be located relative to the orientation of the distortion. Ref. [4] provides a point of departure. a single harmonic form is assumed for flow coefficient far upstream (Eq. (1) of [4]):

$$\phi_\infty=\Phi-\epsilon\sin\Theta \quad (11)$$

while at the compressor face (Eq. (4) of [4]), a similar expression, with unknown amplitude (A) and phase angle (r) was assumed:

$$\phi_o=\Phi+WA(\xi)\sin(\Theta-r(\epsilon)) \quad (12)$$

Between entrance and compressor face, the flow presumably consists of a uniform shear flow (Eq. (11)) together with an irrotational disturbance having a potential of the form $$\tilde{\phi}=WA^*\sin(\Theta-r^*) \quad (13)$$

where agreement with Eq. (12) is assured by making these definitions:

$$\tan r^*=\frac{\sin r}{\cos r+\epsilon/W_A};\ A^*=A\frac{\sin r}{\sin r^*} \quad (14)$$

Figure 3:
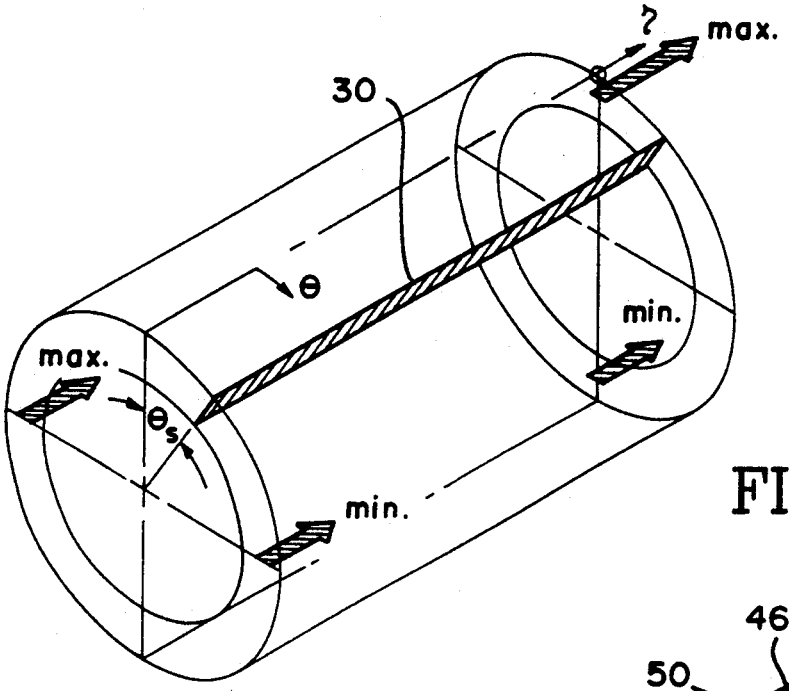
FIG. 3 is perspective view, partly in section and showing a straight annular duct with inlet distortion.

Now, if a divider 30 is located at $\Theta=\Theta_s$ as shown in FIG. 3, we must require circumferential velocity to vanish there:

$$(\tilde{\phi}'_\Theta)_{88}=WA^*\cos(\Theta_s-r^*)=0 \quad (16)$$

which implies that $\Theta_s-r^*=\pi/2$, and, in turn, that $r^*$, r, and A are all constants, independent of time. Eq. (14) therefore yields $$W\frac{A}{\epsilon}=-[\cos r+(\tan\theta_s)\sin r]^{-1} \quad (17)$$

and the "Steady Results for Stall Margin" of [4], Eqs (10)–(12) apply; in particular, $$\frac{A}{\epsilon}=-\frac{2a(1+Q)}{\sqrt{1+[3a[H/W](1-Q^2)]^2}} \quad (18)$$

$$\cot r=-3a(H/W)(1-Q^2) \quad (19)$$

and combining Eqs (17)–(19) yields the divider location which will produce the steady "stall margin" solution for all flow coefficients:

$$\tan\theta_S=\frac{1+[3a(H/W)(1-Q^2)]^2}{2aW(1+Q)}+3a(H/W)(1-Q^2) \quad (20)$$

The implication of the foregoing result is that the steady effect of distortion (loss of performance) normally found only on the stable side of the characteristic ($Q>1$) could also be found on the unstable side if a divider is located at the correct $\Theta_s$, as indicated for one case on FIG. 3. The orientation of the entering distortion pattern is indicated by the arrows marked "Max." and "Min.". At the compressor face, the flow coefficient is found to have maximum and minimum values at different locations ("depending on $\Gamma$ from Eq. (19)).

Figure 4:
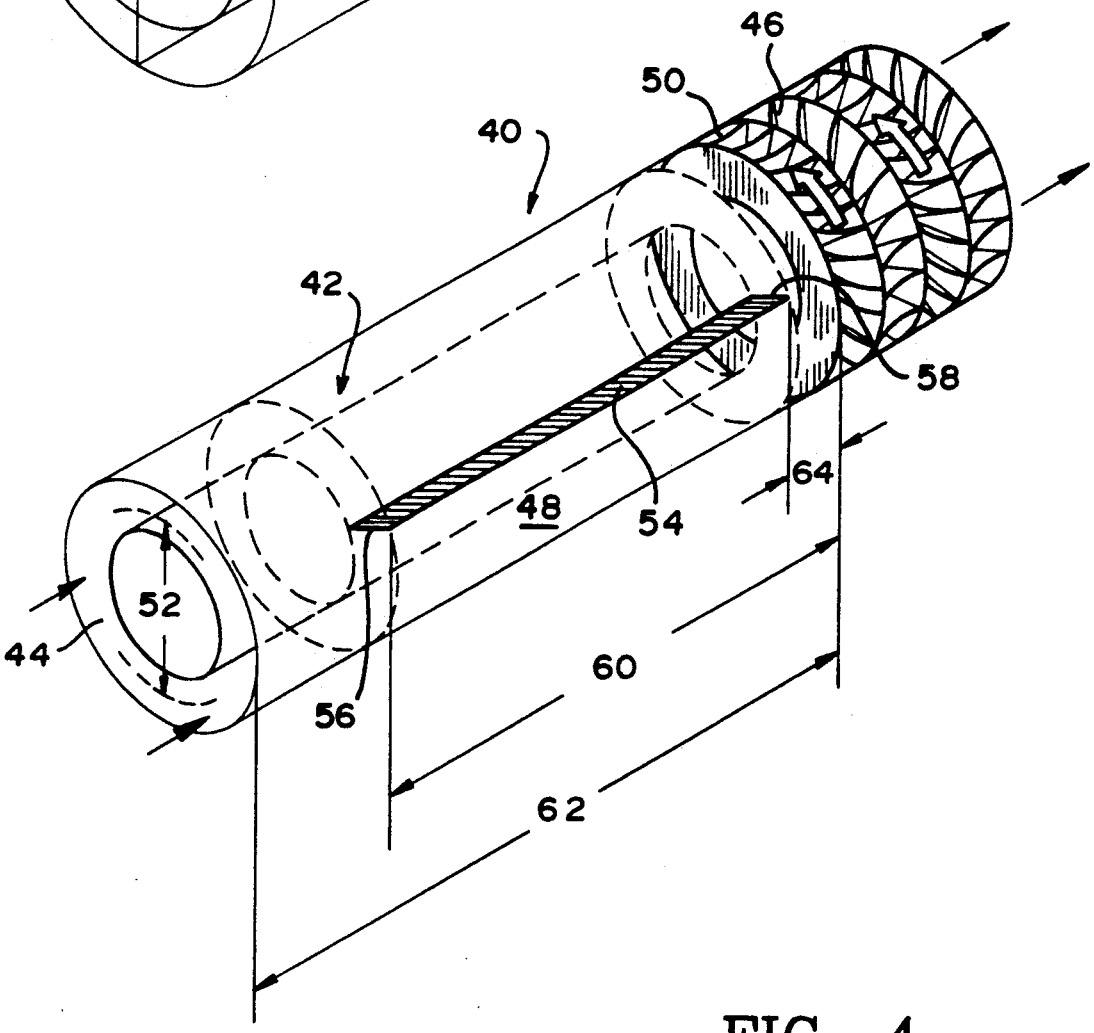
FIG. 4 is a perspective view, partly in section of a first preferred embodiment of an inlet divider to suppress rotating stall of axial compressors in accordance with the present invention.

Referring now to FIG. 4, there may be seen, generally at 40, an axial-flow compressor adapted for the suppression of rotating stall in accordance with the present invention. Compressor 40 has an elongated, generally annular inlet duct 42 which extends from an annular duct inlet opening or mouth 44 to a compressor section, generally at 46. The annular inlet duct 42 provides a generally annular flow passage 48 through which a fluid, such as air flows from the duct inlet opening 44 to the compressor section 46. It will be understood that the compressor section 46 is generally conventional and may be provided with several stages of fixed and/or rotating blades. A first stage or set of blades 50 which is located at the interface of the inlet duct 42 and the compressor section 46 may be a fixed set of inlet guide vanes, as were depicted somewhat schematically in FIGS. 1 and 2. It is these compressor stages and particularly the inlet guide vanes in the first stage 50 which are subjected to rotating stall and to which the suppression of rotating stall in accordance with the present invention is directed.

Referring again to FIG. 4, the annular flow passage 48 of the inlet duct has a mean radius 52 which can be expressed as 2R. An inlet flow divider 54 is positioned in the inlet annular flow passage 48. As seen in FIG. 4, the inlet flow divider 54 is a generally planar plate and has an upstream leading edge 56 and a downstream trailing edge 58. The inlet flow divider 54 is oriented generally parallel to the direction of flow through the annular flow passage 48 and on a plane which would pass through, and extend along the central axis of the inlet duct 42.

The distance 60 of the leading edge 56 of the inlet flow divider 54 from the first compressor stage 50 is generally four times the mean radial size of the inlet duct or 4R. The overall length 62 of the inlet duct 42 is selected to be generally 6.28 times the mean radius of the annular flow passage 48 or 6.28R. The trailing edge 58 of the inlet flow divider 54 is positioned at a spacing 64 from the upstream face of the first compressor stage of generally 0.48 times the mean radius of the annular flow passage 48 or 0.48R. While these various proportions and dimensions provide an operative device, they are not critical limitations. The flow divider 54 should be aligned with the normal through flow through the annular flow passage 48 of the inlet duct 42. Its leading edge 56 should be positioned at least several radii upstream of the compressor 46 while its trailing edge 58 should be a fraction of a radius upstream of the compressor 46. Additionally, while only one inlet flow divider 54 is shown in FIG. 4 positioned in the annular flow passage 48, it will be understood that several spaced flow dividers 54 could be used for reasons of balance or symmetry.

Figures 5A, 5B:
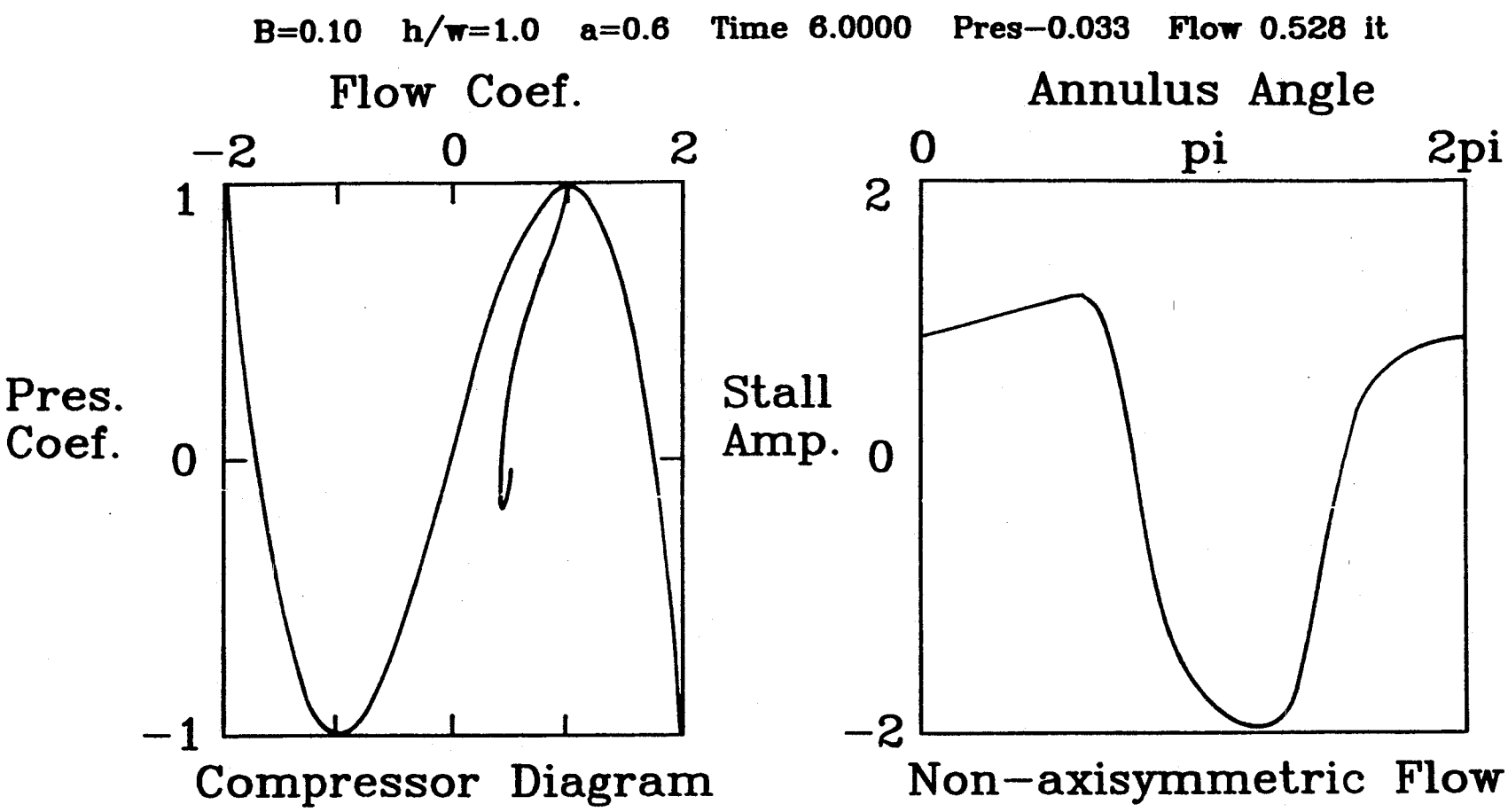
FIGS. 5A and 5B are a depiction of the performance of an axial flow compressor without rotating stall suppressions.
Figure 6B:
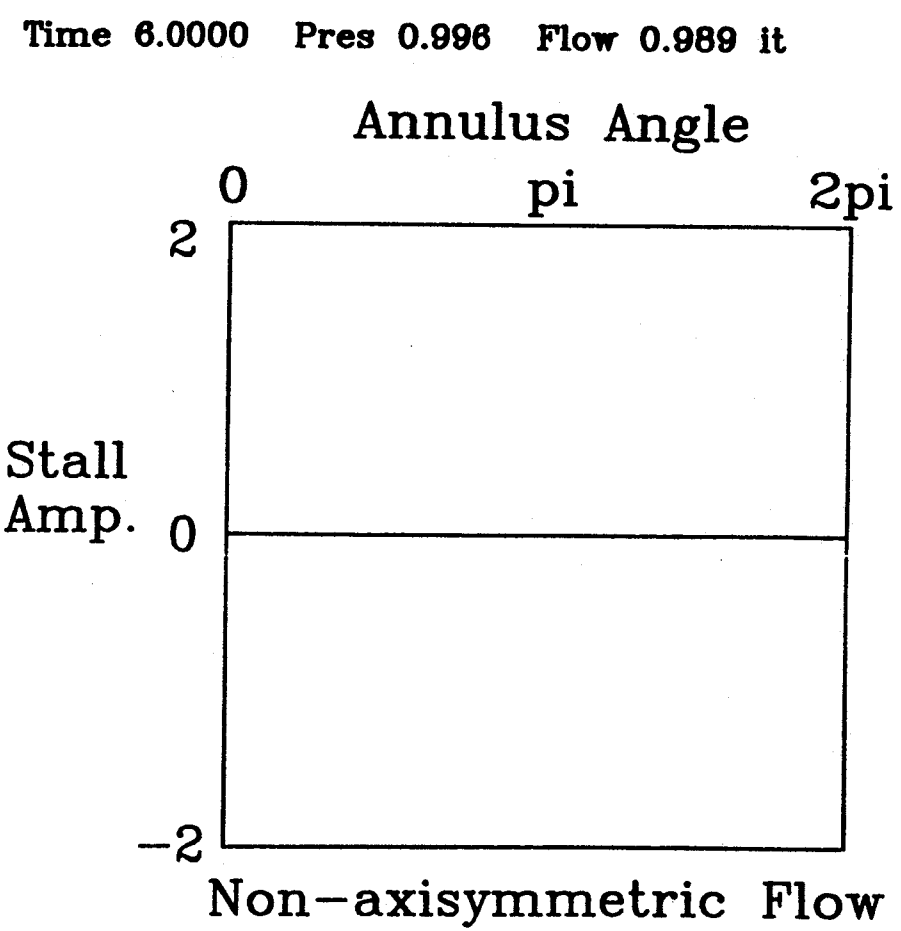
FIGS. 6A and 6B are a depiction of the performance of an axial flow compressor utilizing rotating stall suppression in accordance with the present invention.
Figure 6A:
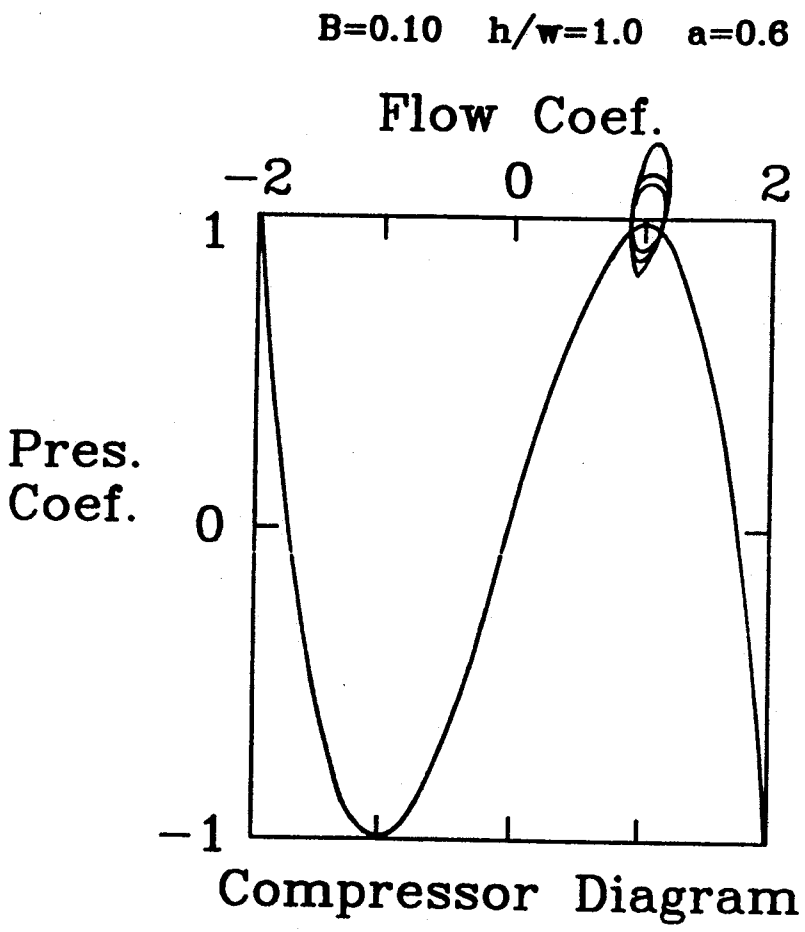

Inlet flow divider 54, when positioned in the inlet duct 42 of an axial-flow compressor, generally at 40 in FIG. 4, will suppress rotating stall in circumstances where it would otherwise be expected. This has been established utilizing suitable parameters and computer modeling. On FIGS. 5A and 5B there is shown, on the left, a conventional pressure-mass flow map, with a typical computed drop into rotating stall when the Greitzer B-parameter is very small (0.10) and other parameter "H/W" and "a" have typical values. On the right is the corresponding computed rotating-stall wave, of large amplitude which shows fully-developed rotating stall. In FIG. 6A and 6B there is shown a depiction of a corresponding event with the inlet flow divider in accordance with the present invention in place. As may clearly be seen in FIG. 6B no rotating stall wave appears. This clearly demonstrates the effectiveness of the rotating stall suppression that is accomplished utilizing the inlet flow divider in accordance with the present invention.

While a preferred embodiment of an assembly for the suppression of rotating stall in an axial-flow compressor in accordance with the present invention has been set forth fully and completely hereinabove, it will be apparent to one of skill in the art that a number of changes in, for example, the overall size of the inlet flow duct, the type of axial-flow compressor, the material used to fabricate the inlet flow divider and the like can be made without departing from the true spirit and scope of the present invention which is accordingly to be limited only by the following claims.

What is claimed is:

1. An assembly for suppression of rotating stall in an axial-flow compressor comprising:

an inlet duct for directing flow of fluid to an axial flow compressor, said inlet duct having a central axis;

an annular flow passage in said inlet duct, said annular flow passage having an inlet opening located upstream of said axial-flow compressor and extending from said inlet opening to a first stage of said axial flow compressor; and an inlet flow divider positioned completely within said annular flow passage; said inlet flow divider being generally planar and being on a plane which passes through and extends along said central axis of said inlet duct, said inlet flow divider further being aligned with the flow of fluid through said inlet duct to interfere with the formation of any rotating wave in said flow of fluid in said flow passage.

2. The rotating stall suppression assembly of claim 1 wherein said inlet flow divider has a leading edge and a trailing edge.

3. The rotary stall suppression assembly of claim 2 wherein said annular flow passage has a mean radius and further wherein said leading edge of said inlet flow divider is located at least two radii upstream of said axial-flow compressor.

4. The rotating stall suppression assembly of claim wherein said trailing edge of said inlet flow divider is located less than one radius upstream of said axial-flow compressor.

5. The rotating stall suppression assembly of claim 3 wherein said inlet duct has a length of at least six radii and further wherein said leading edge of said inlet flow divider is located generally four radii upstream of said axial-flow compressor.

6. The rotating stall suppression assembly of claim 5 wherein said trailing edge of said inlet flow divider is located generally one-half radius upstream of said axial flow compressor.

7. An assembly for suppression of rotating stall in an axial-flow compressor comprising:

an inlet duct for directing flow of fluid to an axial flow compressor;

an annular flow passage in said inlet duct, said annular flow passage having a mean radius and having an inlet opening located upstream of said axial-flow compressor; and an inlet flow divider positioned in said annular flow passage, said inlet flow divider having a leading edge and a trailing edge and being aligned with the flow of fluid through said inlet duct, said leading edge of said inlet flow divider being located generally four radii upstream of said axial-flow compressor and said inlet duct having a length of at least six radii.

8. The rotating stall suppression assembly of claim 7 wherein said trailing edge of said inlet flow divider is located generally one-half radius upstream of said axial-flow compressor.

9. An apparatus for suppression of rotating stall comprising:

an axial-flow compressor having a central axis and having at least a first set of inlet guide vanes subject to rotating stall;

an inlet duct for directed flow of fluid to said first set of inlet guide vanes, said inlet duct having an axis which is coaxial with said central axis of said axial-flow compressor;

an annular fluid flow passage within and coaxial with said inlet duct, said annular fluid flow passage having an annular mouth remote from said inlet guide vanes and extending to said first set of inlet guide vanes; and an inlet flow divider positioned completely within said annular flow passage, said inlet flow divider being generally planar and being on a plane which passes through, and extends along said axis of said inlet duct, said inlet flow divider further being aligned with the flow of fluid through said inlet duct and interfering with the formation of any rotating wave in said flow of fluid in said flow passage caused by rotating stall in said axial-flow compressor to thereby suppress said rotating stall.

10. The apparatus of claim 9 wherein said inlet flow divider has an upstream leading edge and a downstream trailing edge.

11. The apparatus of claim 10 wherein said trailing edge is located adjacent said first set of inlet guide vanes.

12. The apparatus of claim 11 wherein said leading edge is located adjacent said annular mouth.

* * * * *

UNITED STATES PATENT AND TRADEMARK OFFICE

CERTIFICATE OF CORRECTION

PATENT NO. : 5,297,930

DATED : March 29, 1994

INVENTOR(S) : Franklin K. Moore

It is certified that error appears in the above-identified patent and that said Letters Patent is hereby corrected as shown below:

Column 8, line 28,
Claim 4, line 1, after "claim" insert the number --3--.

Signed and Sealed this

Twenty-sixth Day of July, 1994

*Attest:*

Bruce Lehman

BRUCE LEHMAN

*Attesting Officer*

*Commissioner of Patents and Trademarks*